US009646593B2

(12) United States Patent
Watanabe et al.

(10) Patent No.: US 9,646,593 B2
(45) Date of Patent: May 9, 2017

(54) UP/DOWN MOTION DETECTING APPARATUS FOR HI-HAT AND AN ELECTRONIC PERCUSSION INSTRUMENT INCLUDING THE APPARATUS

(71) Applicant: YAMAHA CORPORATION, Hamamatsu-shi, Shizuoka-ken (JP)

(72) Inventors: Haruo Watanabe, Hamamatsu (JP); Hideaki Takehisa, Hamamatsu (JP); Shinya Miyashita, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/215,874

(22) Filed: Jul. 21, 2016

(65) Prior Publication Data

US 2017/0025109 A1 Jan. 26, 2017

(30) Foreign Application Priority Data

Jul. 24, 2015 (JP) ..... 2015-146481

(51) Int. Cl.

| | |
|---|---|
| ***G10D 13/02*** | (2006.01) |
| ***G10H 1/32*** | (2006.01) |
| ***G10H 3/14*** | (2006.01) |
| ***G10D 13/06*** | (2006.01) |

(52) U.S. Cl.

CPC ..... *G10H 3/146* (2013.01); *G10D 13/024* (2013.01); *G10D 13/065* (2013.01); *G10H 3/143* (2013.01)

(58) Field of Classification Search

USPC ..... 84/730

See application file for complete search history.

(56) References Cited

U.S. PATENT DOCUMENTS

| | | | | |
|---|---|---|---|---|
| 7,468,483 | B2 * | 12/2008 | Yoshino | G10H 1/34 84/104 |
| 7,820,903 | B2 * | 10/2010 | Susami | G10H 1/06 84/615 |
| 2012/0118130 | A1 * | 5/2012 | Field | G10H 3/146 84/730 |
| 2015/0287396 | A1 * | 10/2015 | Wei | G10H 3/00 84/422.3 |

FOREIGN PATENT DOCUMENTS

JP 2009128805 A 6/2009

* cited by examiner

*Primary Examiner* — Christopher Uhlir

(74) *Attorney, Agent, or Firm* — Rossi, Kimms & McDowell LLP

(57) ABSTRACT

An electronic percussion instrument includes an up/down motion detecting apparatus for a hi-hat for detecting up/down motions of the hi-hat regardless of a type of the hi-hat. An interlocked portion moves in response to up/down motions of the hi-hat mounted on an extension rod that constitutes a hi-hat stand. A seat unit does not move in response to up/down motions of the hi-hat. A sensor is provided on the seat unit. A connecting portion connects the interlocked portion and the sensor together and converts up/down motions of the interlocked portion into motions detectable by the sensor.

15 Claims, 7 Drawing Sheets

UP/DOWN MOTION DETECTING APPARATUS FOR HI-HAT AND AN ELECTRONIC PERCUSSION INSTRUMENT INCLUDING THE APPARATUS

BACKGROUND OF THE INVENTION

Field of the Invention

The present invention relates to an apparatus that detects up/down motions of a hi-hat.

Description of the Related Art

As an apparatus that detects up/down motions of a hi-hat, one incorporated in a hi-hat type electronic pad is known (see, for example, Japanese Laid-Open Patent Publication (Kokai) No. 2009-128805).

This hi-hat type electronic pad is comprised of a hi-hat (hereafter abbreviated as "HH") pad body and a bottom seat which correspond to a top cymbal and a bottom cymbal, respectively, of an acoustic HH. A motion detecting unit is provided in a lowermost part of the HH pad body, and the motion detecting unit has five sheet switches and actuators for the respective sheet switches. The HH pad body is coupled and fixed to an extension rod, and the bottom seat is supported by a seat supporting unit.

In the hi-hat type electronic pad, when a player depresses a foot pedal, the HH pad body moves down with the extension rod in a forward stroke of the pedal operation, and then the motion detecting unit abuts against an upper surface of the bottom seat. After that, in the motion detecting unit, pairs of the actuators and the sheet switches successively abut against the upper surface in order from the pair on an outermost side in a radial direction, and detection signals are output in sequence. As a result, positions to which the HH pad body moves down after the HH pad body (the motion detecting unit thereof) abuts against the upper surface of the bottom seat are detected stepwise (in a backward stroke of the pedal operation, positions to which the HH pad body moves up are detected stepwise as well).

However, the above conventional apparatus that detects up/down motions of the hi-hat is interposed between the HH pad body and the bottom seat so as to be incorporated in the hi-hat type electronic pad and thus cannot be used for other types of electronic pads such as an electronic pad for a cymbal.

Lately, performance in which a musical tone from an acoustic percussion instrument is sounded with a musical tone from an electronic tone generator added thereto is proposed. For example, a trigger pickup is attached to an acoustic snare, and snare performance is sensed to add electronic tones.

However, an acoustic HH cymbal has no mechanism that detects a state of performing operations, and hence an acoustic tone cannot be processed so be more expressive, and an expressive electronic tone cannot be added to an acoustic tone.

SUMMARY OF THE INVENTION

The present invention provides an up/down motion detecting apparatus for a hi-hat, which is capable of detecting up/down motions of the hi-hat irrespective of a type of the hi-hat.

Accordingly, an aspect of the present invention provides an up/down motion detecting apparatus for a hi-hat, comprising an interlocked portion that moves in response to up/down motions of the hi-hat mounted on an extension rod included constitutively in a hi-hat stand, a seat unit that does not move in response to up/down motions of the hi-hat, a sensor provided on the seat unit and a connecting portion that connects the interlocked portion and the sensor with each together and converts up/down motions of the interlocked portion into motions detectable by the sensor.

In a preferred aspect of the present invention, a holding and restricting unit is configured to be able to shift up and down a position to which the hi-hat moves down.

In a further preferred aspect of the present invention, the interlocked portion, the holding and restricting unit, the seat unit, and a mounting portion are configured such that the extension rod is passed through them.

In another preferred aspect of the present invention, the sensor outputs an analog value.

According to the present invention, the up/down motion detecting apparatus for the hi-hat is not incorporated into the hi-hat whose up/down motions are to be detected. Moreover, when detecting up/down motions, the up/down motion detecting apparatus does not use structural features of the hi-hat. Further, the up/down motion detecting apparatus is removably mounted on the hi-hat stand. As a result, the up/down motion detecting apparatus is able to detect up/down motions of the hi-hat irrespective of a type of the hi-hat.

Moreover, according to the present invention, the holding and restricting unit is configured to be able to shift up and down the position to which the hi-hat moves down. Therefore, with one up/down motion detecting apparatus for the hi-hat, it is possible not only to detect up/down motions of the hi-hat but also to adjust the position to which the hi-hat moves down.

Further, according to the present invention, since the interlocked portion, the holding and restricting unit, the seat unit, and the mounting portion are configured such that the extension rod is passed through them, the up/down motion detecting apparatus is allowed to be extended linearly along the extension rod. This makes the up/down motion detecting apparatus compact as a whole.

Moreover, according to the present invention, since the sensor outputs analog values, it is possible to detect up/down motions of the hi-hat in an extremely minute manner as compared to conventional apparatuses that detect up/down motions of the hi-hat stepwise (digitally) by turning-on and -off of a plurality of switches.

Further features of the present invention will become apparent from the following description of exemplary embodiments (with reference to the attached drawings).

DESCRIPTION OF THE EMBODIMENTS

Hereafter, an embodiment of the present invention will be described in detail with reference to the drawings.

Figure 1:
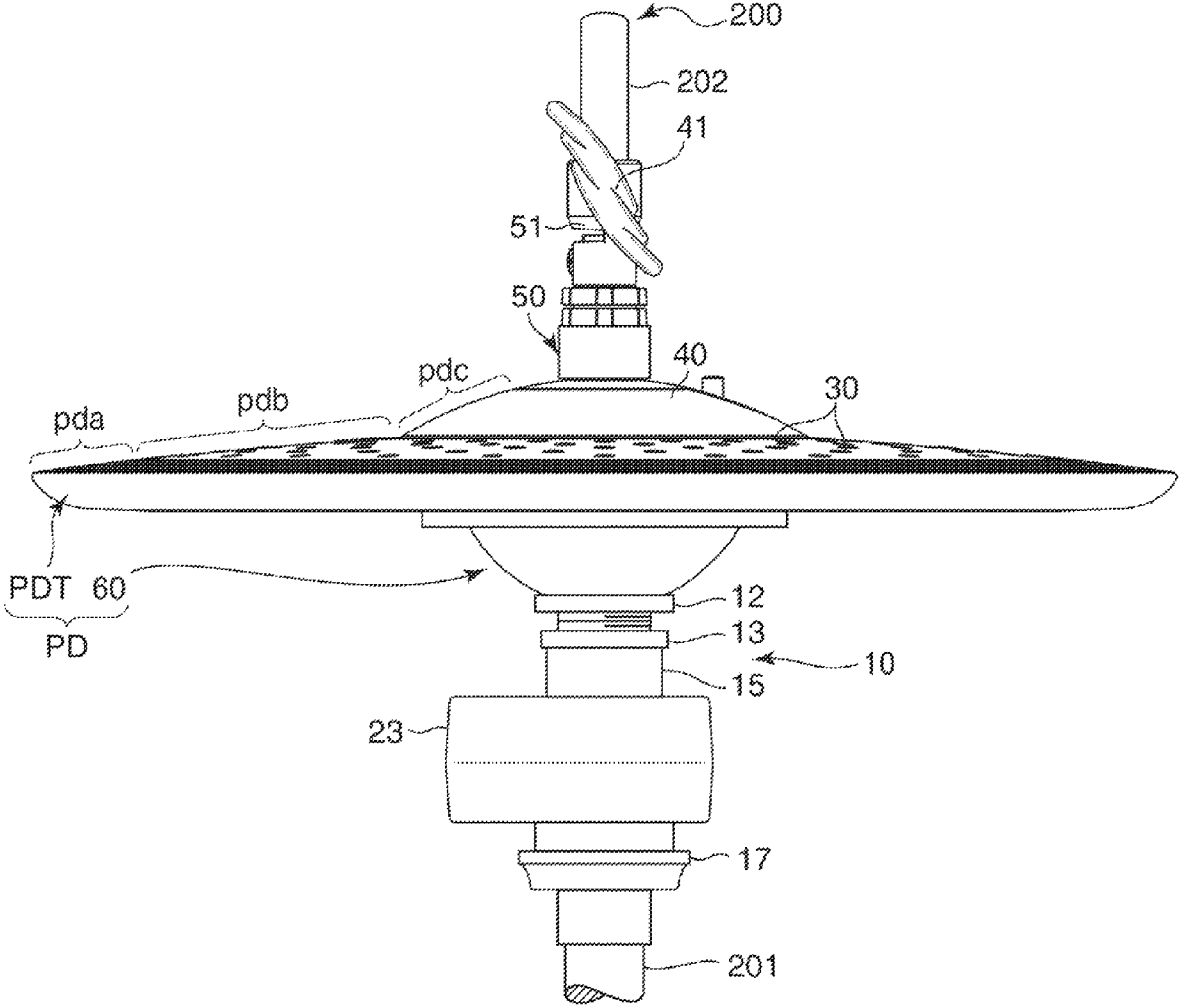
FIG. 1 is a right side view showing a state where an up/down motion detecting apparatus according to an embodiment of the present invention and a hi-hat type electronic pad are mounted on a stand.

FIG. 1 is a right side view showing a state where a hi-hat up/down motion detecting apparatus (hereafter abbreviated as "the up/down motion detecting apparatus") 10 according to the embodiment of the present invention and a hi-hat type electronic pad (hereafter abbreviated as "the electronic pad") PD are mounted on a stand 200.

The stand 200 is comprised mainly of a main body pipe 201 which is able to support the up/down motion detecting apparatus 10, a leg member (not shown) which supports the main body pipe 201 in a standing manner, an extension rod 202 which is an operating rod for the electronic pad PD and is provided so as to be able to move up and down with respect to the main body pipe 201, and a foot pedal (not shown) that is placed under the extension rod 202. The construction of the stand 200 is substantially the same as that of a stand for an acoustic HH.

The electronic pad PD is comprised of an HH pad body PDT and a bottom seat 60, each of which is formed in a circular shape as viewed in plan. The HH pad body PDT and the bottom seat 60 correspond to a top cymbal and a bottom cymbal, respectively, of an acoustic HH cymbal.

The HH pad body PDT is horizontally supported for pivotal motion by a supporting unit 50. The supporting unit 50 includes a supporting rod fastener 51, which is provided with a clinching knob 41. When the knob 41 is tightened in a state where the extension rod 202 is inserted into an insertion hole (not shown) in an upper half of the supporting rod fastener 51, a tip end of the knob 41 depresses the extension rod 202 in the insertion hole, whereby an outer peripheral side surface of the extension rod 202 is brought in pressure-contact with an inner peripheral surface of the insertion hole. As a result, the entire supporting unit 50 is coupled and fixed to the extension rod 202 via the supporting rod fastener 51.

The extension rod 202 is moved down when the foot pedal is depressed, and when the pedal depression is released, the extension rod 202 is moved up by an urging means, not shown. When the extension rod 202 thus moves up and down, the supporting unit 50 as well moves up and down in response to up/down motions of the extension rod 202, causing the HH pad body PDT as well to move up and down.

The HH pad body PDT is comprised mainly of a frame 40 and a rubber pad 30 that provides a percussion surface. The frame 40 is made of a hard material such as PP (polypropylene) that is able to reduce undesired vibrations by internal loss and also absorb flexure when strongly struck. A plurality of sheet sensors (not shown) is attached to a predetermined place on a surface of the frame 40, and one piezo-sensor (not shown) is attached to a predetermined place on a rear surface of the frame 40.

On an upper surface of the HH pad body PDT, a cup pdc corresponding to a radially central portion, a circumferential portion pda corresponding to an edge, and a ride area (bow) pdb extending between the cup pdc and the circumferential portion pda are provided as areas which are, for example, struck in performance operation. The cup pdc and the ride area pdb are struck solely by a stick, whereas the circumferential portion pda is not only struck but also held between fingers from above and below (mute operation).

The piezo-sensor detects a vibration mainly produced when the ride area pdb is struck, and outputs a detection signal indicative of whether or not striking is made and the strength of the striking. One of the sheet sensors detects striking to the cup pdc, and outputs a detection signal indicative of whether or not the striking is made. The other sheet sensors detect striking to the circumferential portion pda and a mute operation of depressing the circumferential portion pda from above and below, and output a detection signal indicative of whether or not the striking is made and whether or not the mute operation is performed.

Figure 2:
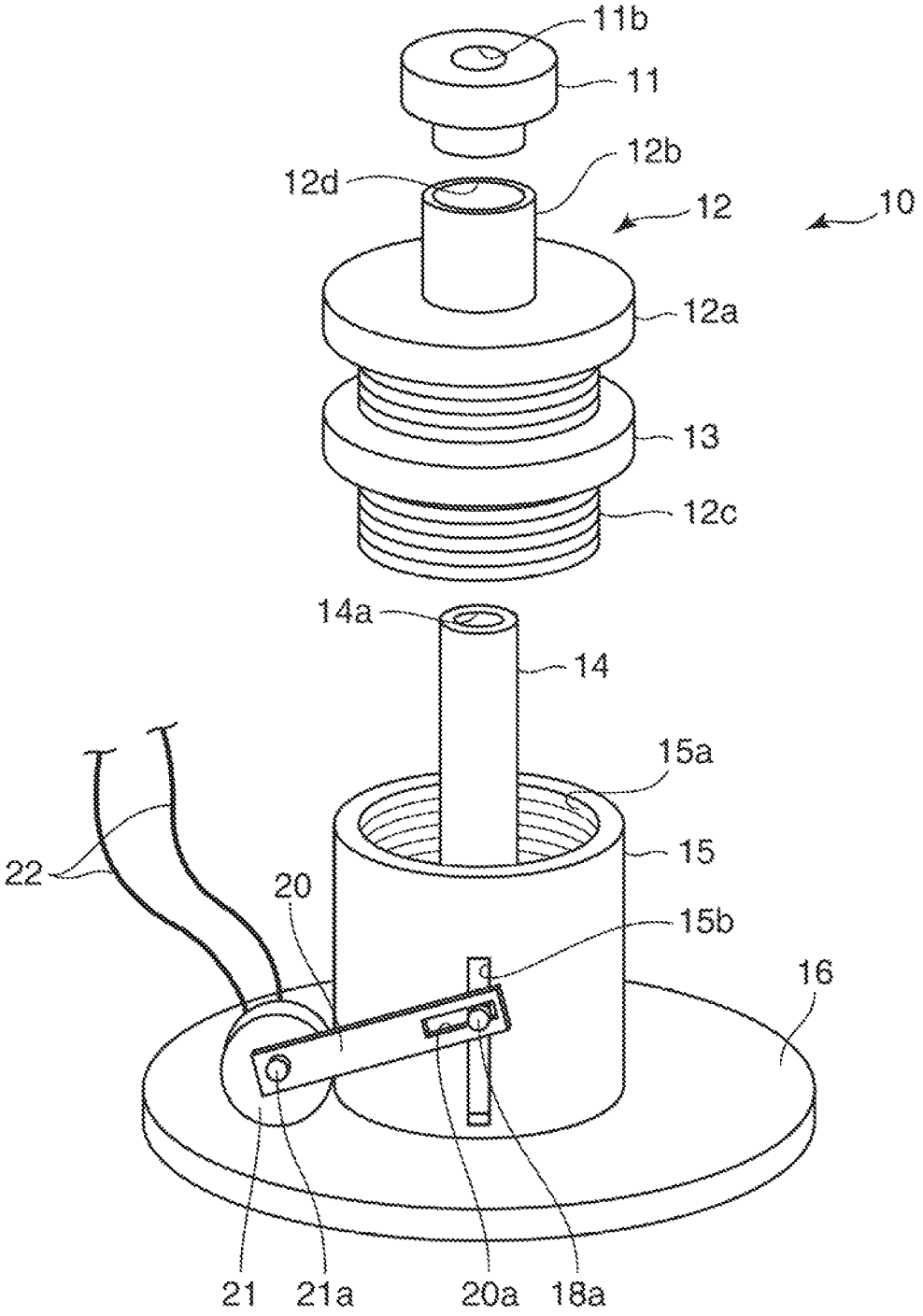
FIG. 2 is a perspective view schematically showing a construction of the up/down motion detecting apparatus for the hi-hat in FIG. 1 with a main body cover removed.
Figure 3:
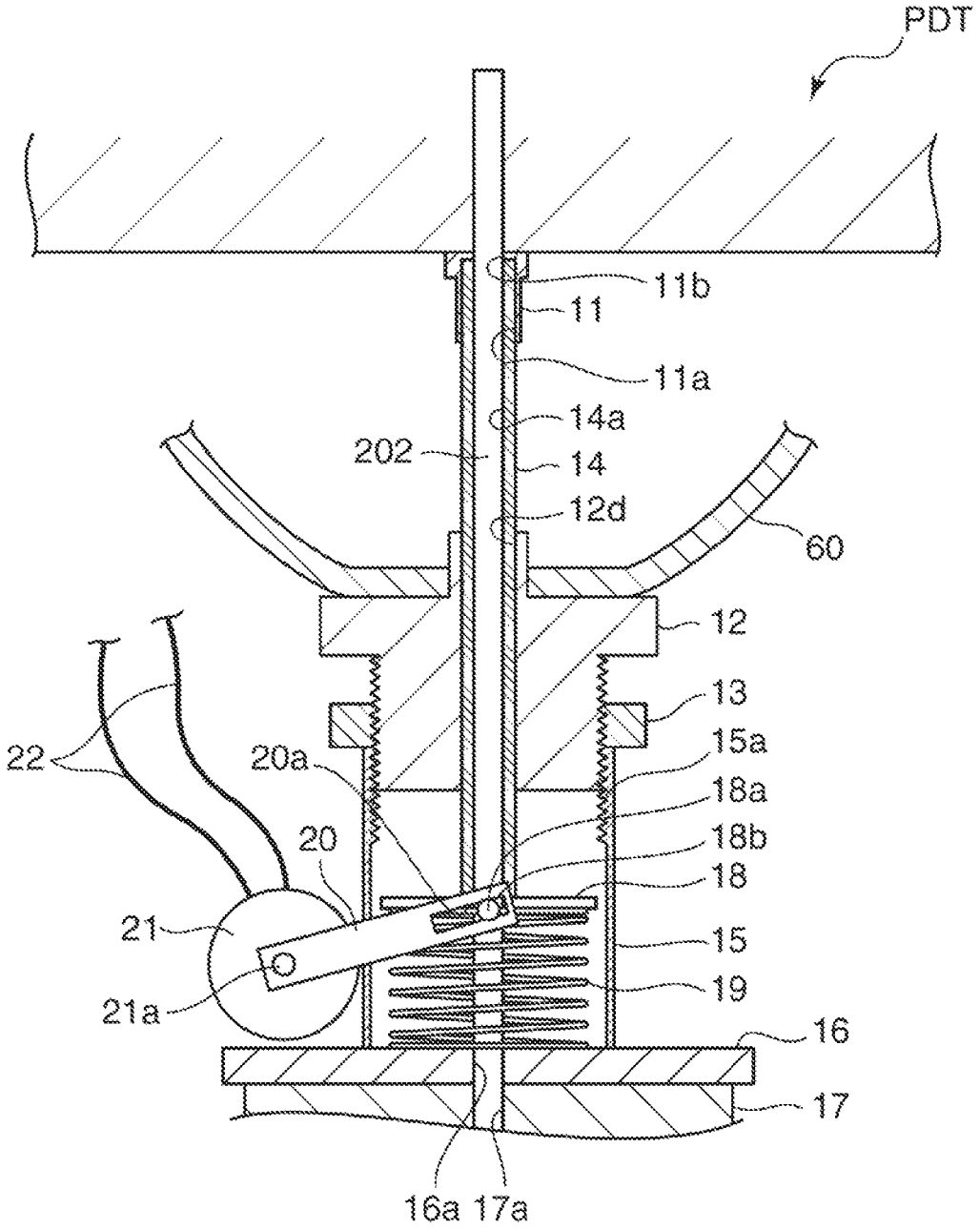
FIG. 3 is a partial cross-sectional view showing an internal construction of the up/down motion detecting apparatus for the hi-hat in FIG. 2.

FIG. 2 is a perspective view showing a construction of the up/down motion detecting apparatus 10, and FIG. 3 is a partial cross-sectional view showing an internal construction of the up/down motion detecting apparatus 10. It should be noted that both FIG. 2 and FIG. 3 show a state where a main body cover 23 has been removed from the up/down motion detecting apparatus 10. These figures, however, are drawn simply so as to make the construction inside the main body cover 23 clear, and hence precise configurations of the up/down motion detecting apparatus 10 including its external configuration are not drawn.

In the present embodiment, the up/down motion detecting apparatus 10 detects up/down motions of the HH pad body PDT and has a seat unit 16 as shown in FIG. 2.

A through hole 16*a* (see FIG. 3) through which the extension rod 202 is passed is formed at a predetermined position (for example, in proximity to a central part) of the seat unit 16. On the seat unit 16, a cylindrical body 15 is placed in a standing manner outside and concentrically with the through hole 16*a*.

A female thread 15*a* is formed in an inner peripheral portion of the cylindrical body 15. A slotted hole 15*b* which extends vertically is provided in a side face of the cylindrical body 15. Through the slotted hole 15*b*, a projecting portion 18*a* placed in a standing manner on a side face of a disc 18 (see FIG. 3) is projected outwardly from the inside of the cylindrical body 15. The disc 18 moves up and down inside the cylindrical body 15 as will be described later, and hence, the projecting portion 18*a* placed in a standing manner on the disc 18 as well moves up and down along the slotted hole 15*b*. Therefore, the length of the slotted hole 15*b* in a longitudinal direction thereof defines a length over which the projecting portion 18*a* is movable up and down.

A coil spring 19 is inserted into the cylindrical body 15 as shown in FIG. 3. A lower end of the coil spring 19 abuts against the seat unit 16, and the disc 18 with a through hole 18*b* is mounted on an upper end of the coil spring 19. The extension rod 202 is passed through the through hole 18*b*. A pipe-shaped interlocked portion 14 is placed on the disc 18. As will be described later, the interlocked portion 14 is fitted in an abutment portion 11, against which a bottom surface of the HH pad body PDT abuts, and thus moves up and down in response to up/down motions of the HH pad body PDT of the electronic pad PD. The extension rod 202 is passed through the interlocked portion 14, and as described above, when the extension rod 202 moves up and down, the HH pad body PDT as well moves up and down in unison therewith, and hence the extension rod 202 and the interlocked portion 14 move up and down at the same time. The disc 18 is urged toward the interlocked portion 14 by the coil spring 19 to abut against the interlocked portion 14, and hence the disc 18 moves up and down integrally with the interlocked portion 14. On the other hand, since the extension rod 202 is passed through the through hole 16*a* of the seat unit 16, the seat unit 16 does not move in response to movement of the electronic pad PD, and as a result, the seat unit 16 does not move in response to up/down motions of the HH pad body PDT of the electronic pad PD.

A movement restricting unit 12 (a holding and restricting unit) supports the bottom seat 60 to restrict a lowermost position of the HH pad body PDT that has moved down. Namely, the bottom seat 60 is supported in a state of being held at a predetermined level by the movement restricting unit 12, and therefore, once the HH pad body PDT that has moved down abuts against the bottom seat 60, it cannot move down any longer.

The movement restricting unit 12 is comprised of a supporting portion 12*a*, a horizontal position restricting portion 12*b*, and a cylindrical portion 12*c*. The supporting portion 12*a* supports the bottom seat 60 by abutting against a bottom surface thereof. The horizontal position restricting portion 12*b* is a cylindrical body placed in a standing manner on the supporting portion 12*a*. This cylindrical body is fitted into a hole formed in the bottom surface of the bottom seat 60, whereby the horizontal position restricting portion 12*b* restricts a position of the bottom seat 60 in a horizontal direction. The cylindrical portion 12*c* is provided contiguous with a lower part of the supporting portion 12*a*. A male thread corresponding to the female thread 15*a* mentioned above is formed in an outer periphery of the cylindrical portion 12*c*. The movement restricting unit 12 is also provided with a through hole 12*d* through which the interlocked portion 14 is passed.

The movement restricting unit 12 is engaged with and contiguous with the cylindrical member 15, and when they are placed contiguous with each other, the direction in which and the amount by which the movement restricting unit 12 is rotated with respect to the cylindrical body 15 are adjusted to change a position (height) of the movement restricting unit 12 in a vertical direction. A round nut 13 is engaged with the cylindrical portion 12*c* of the movement restricting unit 12. The round nut 13 prevents the movement restricting unit 12 from rotating due to vibrations or the like and changing its height adjusted by a user.

The abutment portion 11 against which a bottom surface of the HH pad body PDT of the electronic pad PD abuts is fitted on an upper end of the interlocked portion 14. Accordingly, the abutment portion 11 is provided with a hole 11*a* for fitting the interlocked portion 14 therein, and a through hole 11*b* through which the extension rod 202 is passed and the diameter of which begins to decrease in the middle.

A volume (variable resistor) 21, which is a rotary sensor that detects up/down motions of the electronic pad PD, is fixed on the seat unit 16. The volume 21 has a knob 21*a*, which projects out around a rotational center, and an arm-shaped connecting portion 20, which projects sideward of the knob 21*b* and vertically to a rotational axis of the knob 21*a*. Rotating the knob 21*a* causes a volume value, that is, a resistance value of the volume 21 to change. Thus, when the connecting portion 20 rotates about the rotational axis of the knob 21*a*, the knob 21*a* rotates to cause a resistance value of the volume 21 to change. Here, the connecting portion 20 has a slotted hole 20*a*, which is formed in a manner extending in a longitudinal direction thereof, and is connected to the disc 18 by fitting a projecting portion 18*a* of the disc 18 into the slotted hole 20*a*. When moving up and down within the slotted hole 15*b*, the projecting portion 18*a* as well moves up and down the connecting portion 20. At this time, the direction in which the projecting portion 18*a* moves up and down and the direction in which the slotted hole 20*a* of the connecting portion 20 extends are different, and hence the projecting portion 18*a* slides in contact with the slotted hole 20*a* of the connecting portion 20 along the direction in which the slotted hole 20*a* of the connecting portion 20 extends, causing up/down motions of the projecting portion 18*a* to be converted into rotary motions of the connecting portion 20. Namely, the connecting portion 20 acts as a link mechanism that converts up/down motions of the projecting portion 18*a* into rotary motions of the knob 21*a*.

It should be noted that the volume 21 is not limited to one which is caused to change its volume value through rotating operations, but one which is caused to change its volume value through linear operations may be adopted as the volume 21. In this case, a linear motion of the projecting portion 18*a* should be used directly or enlarged/reduced to be used for operation of the volume. However, a rotary volume is more universal and smaller than a linear volume, and hence to reduce the size of the up/down motion detecting apparatus 10, it is more preferred that the volume 21 of a rotary type is adopted.

A mounting portion 17 is provided on a rear side of the seat unit 16 as shown in FIG. 1. The mounting portion 17 is placed on a tip end of the main body pipe 201 and mounted on the main body pipe 201 using a predetermined fixing method (for example, by fastening with screws). It should be noted that a through hole 17*a* through which the extension rod 202 is passed is formed in the mounting portion 17 as well (see FIG. 3).

A description will now be given of an exemplary method to mount the up/down motion detecting apparatus 10 and the electronic pad PD, which are constructed as described above, on the stand 200.

In the stand 200, first, the extension rod 202 is inserted into the main body pipe 201, and nothing is attached to the extension rod 202. Next, the extension rod 202 is passed through the up/down motion detecting apparatus 10, the up/down motion detecting apparatus 10 is placed on a tip end of the main body pipe 201, and the up/down motion detecting apparatus 10 is mounted on the stand 200 by fixing the mounting portion 17 to the main body pipe 201 as described above.

Then, the extension rod 202 and the interlocked portion 14, on which the abutment portion 11 is fitted, are passed through the bottom seat 60, which in turn is placed on the movement restricting unit 12 (the supporting portion 12*a* thereof).

After that, the extension rod 202 is passed through the HH pad body PDT, and the extension rod 202 is mounted on the HH pad body PDT so that a bottom surface of the HH pad body PDT can abut against the abutment portion 11. At this time, the foot pedal has not been operated, and hence the bottom surface of the HH pad body PDT and an upper surface of the bottom seat 60 are a predetermined distance away from each other.

To increase or decrease a distance between the HH pad body PDT and the bottom seat 60 when a player has depressed the foot pedal to bring the electronic pad PD into a closed state, that is, lower the HH pad body PDT, he or she adjusts the distance by rotating the movement restricting unit 12 (the supporting portion 12*a* of).

A description will now be given of how the up/down motion detecting apparatus 10 and the electronic pad PD, which have been completely mounted on the stand 200 in the above described manner, operate with a focus placed on the up/down motion detecting apparatus 10.

FIG. 3 shows a state where the foot pedal has not been operated. When the player starts to depress the foot pedal in the state shown in the figure, the HH pad body PDT slowly moves down. Accordingly, the bottom surface of the HH pad body PDT pushes down the interlocked portion 14, causing the disc 18 as well to be pushed down against an upward urging force of the coil spring 19 and causing the projecting portion 18*a* to be pushed down as well. When the projecting portion 18*a* has thus moved down, the connecting portion 20 converts a linear motion into a rotary motion as described earlier, causing the knob 21*a* of the volume 21 to rotate. As a result, the volume value of the volume 21 is changed, causing a value of current passed through a cord 22, which is an analog value, to change. An operating interface 111, to be described later, receives this current value (actually, an analog value obtained by conversion into a voltage value) and converts it into height information on the HH pad body PDT (hereafter referred to as "the pad height information"). The pad height information is stored in, for example, a pad height information storage area (not shown) reserved on a RAM 103.

When the player further depresses the foot pedal, the electronic pad PD is brought into the closed state. When the electronic pad PD is brought into the closed state in the end, the HH pad body PDT does not move down any longer, and hence the disc 18 reaches a lowermost position within a movable range. As a result, the volume value of the volume 21 as well reaches a maximum value within a variable range.

Conversely, as the player decreases the amount by which he or she depresses the foot pedal, the electronic pad PD moves up accordingly, and an upward urging force of the coil spring 19 move up the disc 18 and the interlocked portion 14 so as to maintain a state where the abutment portion 11 abuts against the HH pad body PDT. This causes the knob 21*a* of the volume 21 to reversely rotate via the connecting portion 20, and hence the volume value changes reversely. Therefore, the pad height information is changed to indicate a greater height.

The construction and operation of the up/down motion detecting apparatus 10 have been described by way of an example in which it is applied to the electronic pad PD, that is, a hi-hat type electronic pad. The up/down motion detecting apparatus 10, however, may be applied to other types of electronic pads such as an electronic pad for a cymbal and detect its up/down motions. This is because an only difference between an electronic pad for a cymbal and the electronic pad PD of the hi-hat type is in the presence or absence of the bottom seat 60. Further, the up/down motion detecting apparatus 10 may be applied to an acoustic HH cymbal and detect its up/down motions, because only difference between an acoustic HH cymbal and the electronic pad PD of a hi-hat type is in a difference between a bottom cymbal and the bottom seat 60. As a matter of course, a top cymbal and the HH pad body PDT differ in outer shape, but the up/down motion detecting apparatus 10 is disposed on a bottom side of an object to be detected, and a bottom surface of the object to be detected is used to detect up/down motions. Thus, even when objects to be detected vary in outer shape, up/down motions are detected without any problems by using the up/down motion detecting apparatus 10.

As described above, the up/down motion detecting apparatus 10 is not placed between the HH pad body PDT and the bottom seat 60, but is disposed on the bottom side of the bottom seat 60, the degree of flexibility in placing the up/down motion detecting apparatus 10 is increased, and whatever types of hi-hats, the up/down motion detecting apparatus 10 is easily mounted on the hi-hats and thus able to detect up/down motions of the hi-hats.

It should be noted that although in the present embodiment, an object to be moved in response to the movement of the interlocked portion 14 is the bottom surface of the HH pad body PDT (a top cymbal in the case of an acoustic HH cymbal), this is not limitative, but an object to be moved in response to movement of the interlocked portion may be the extension rod 202.

It should be noted that although in the present embodiment, an urging force of the coil spring 19 keeps the interlocked portion 14 continuously in abutment against an object to be interlocked (by way of the abutment portion 11), this is not limitative, but the interlocked portion 14 may be connected to an object to be interlocked.

Figure 4:
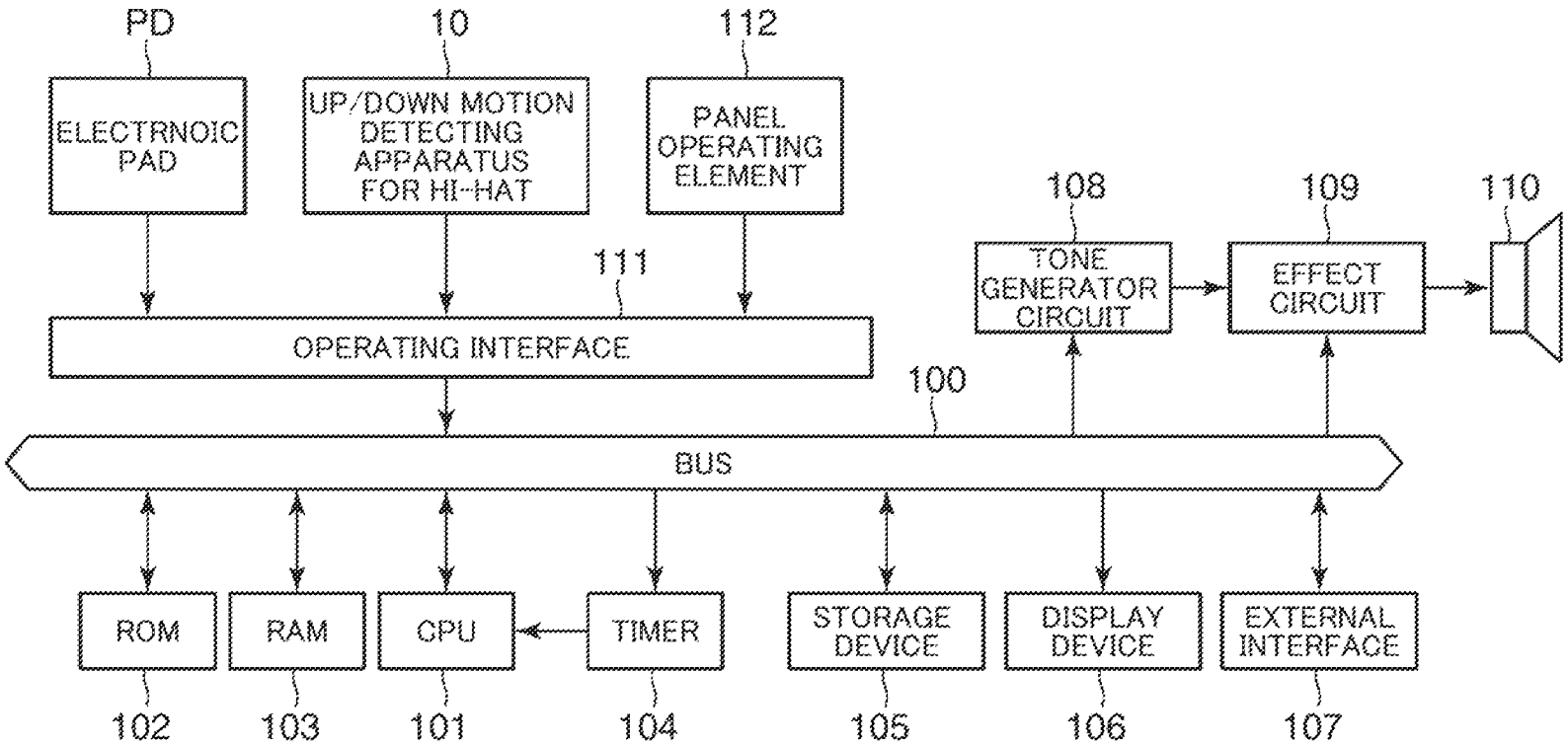
FIG. 4 is a block diagram showing a control arrangement of an overall electronic percussion instrument including the electronic pad and the up/down motion detecting apparatus in FIG. 1.

FIG. 4 is a block diagram showing an overall construction of an electronic percussion instrument including the electronic pad PD and the up/down motion detecting apparatus 10. This electronic percussion instrument includes a plurality of electronic pads to be struck, which includes the electronic pad PD, but for brevity, only the electronic pad PD is shown in FIG. 4.

This electronic percussion instrument is constructed such that a ROM 102, the RAM 103, a timer 104, a storage device 105, a display device 106, an external interface 107, the operating interface 111, a tone generator circuit 108, and an effect circuit 109 are each connected to a CPU 101 via a bus 100.

The electronic pad PD, the up/down motion detecting apparatus 10, and a panel operating element 112 are connected to the operating interface 111.

The panel operating element 112 is for inputting a variety of information, and for example, based on detection signals from respective electronic pads, tone colors and forms in which musical tones are to be generated are allowed to be set on the panel operating element 112.

As described earlier, the electronic pad PD outputs a detection signal when an area allowed to be struck (in the present embodiment, the circumferential portion pda, the ride area pdb, and the cup pdc) is struck, and a detection signal when a mute operation is performed, and these detection signals are input to the operating interface 111.

The up/down motion detecting apparatus 10 outputs current as described above, and the operating interface 111 does not receive a current value but receives a voltage value obtained by conversion of the current value.

The operating interface 111 analyzes each of detection signals that have been input thereto, and converts them into corresponding information. Specifically, when a detection signal indicative of striking is output, information indicative of an area that has been struck (information that identifies the circumferential portion pda, the ride area pdb, or the cup pdc) and the strength of the striking (striking power) is obtained and stored in, for example, an input event area (not shown) reserved on the RAM 103. When a detection signal indicative of a mute operation is output, information indicating that a mute operation has been performed and the strength of the mute operation are obtained and stored in the input event area. Further, an output signal (here, a voltage value) from the up/down motion detecting apparatus 10 as well is converted into the pad height information and stored in the pad height information storage area.

The display device 106 is comprised of a liquid crystal display (LCD) or the like and displays a variety of information such as a musical score and characters. The timer 104 is connected to the CPU 101. The external interface 107 includes various interfaces such as a MIDI (musical instrument digital interface) interface and a LAN (local area network). A sound system 110 is connected to the effect circuit 109.

The CPU 101 is responsible for controlling the entire electronic percussion instrument. The ROM 102 stores control programs to be executed by the CPU 101, various table data, and so on. The RAM 103 temporarily stores various input information such as performance data and text data, various flags, buffer data, computation results, and so on. The timer 104 measures an interrupt time in timer interruption processing and various times. The storage device 105 stores various application programs including the control programs, various music data, various data, and so on.

The external interface 107 sends and receives MIDI signals and various data to and from external equipment. The tone generator circuit 108 converts performance data based on detection signals input from the electronic pads PD and performance data set in advance into musical tone signals. The effect circuit 109 adds various effects to musical signals input from the tone generator circuit 108. The sound system 110 includes a DAC (digital-to-analog converter), an amplifier, a speaker, and so on, and converts, for example, musical signals input from the effect circuit 109 into sounds.

Figure 5:
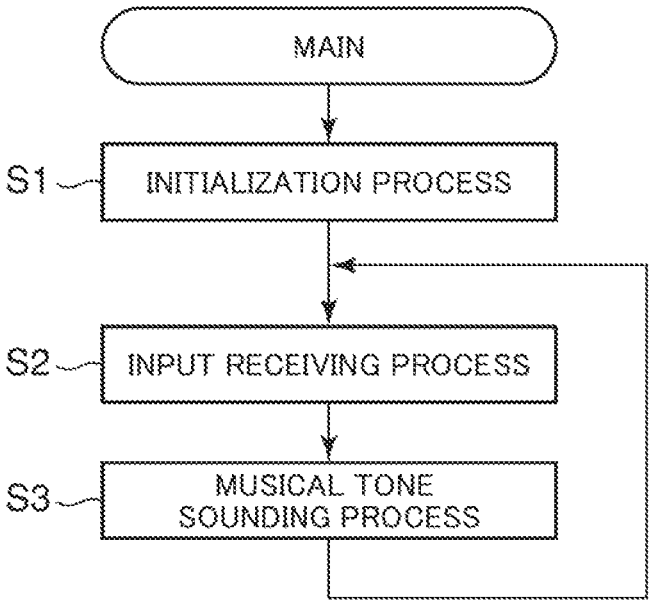
FIG. 5 is a flowchart showing the procedure of a main routine that is executed by the electronic percussion instrument in FIG. 4, and more particularly, a CPU.

FIG. 5 is a flowchart showing the procedure of a main routine that is executed by the present electronic percussion instrument, and more particularly, the CPU 101.

The present main routine is comprised mainly of an initialization process (step S1), an input receiving process (step S2), and a musical tone sounding process (step S3). The present main routine is started when the power to the present electronic percussion instrument is turned on, and after the initialization process is carried out once, the input receiving process and musical tone sounding process are repeatedly carried out until the power is turned off.

In the initialization process, the CPU 101 clears the RAM 103, sets values of various parameters to default values, causes the timer 104 to start clocking, and permits the timer 104 to generate an interrupt signal so as to start a timer interruption process.

In the input receiving process, the CPU 101 constantly monitors the electronic pad PD (the electronic pads including the same), the up/down motion detecting apparatus 10, and the panel operating element 112, and when there is any input, a process is carried out according to the input.

In the musical tone sounding process, the CPU 101 supplies performance data, which is generated by the input receiving process, to the tone generator circuit 108 and orders the tone generator circuit 108 to sound a musical tone based on the performance data. In the present embodiment, the sounded musical tone is assumed to be only a tone generated by a percussion instrument, and hence it is canceled automatically inside the tone generator circuit 108. As a matter of course, this is not limitative, but the timing of tone canceling may be determined by the input receiving process, and when the timing of tone canceling comes in the musical tone sounding process, the tone generator circuit 108 may be ordered to cancel the musical tone.

Figure 6:
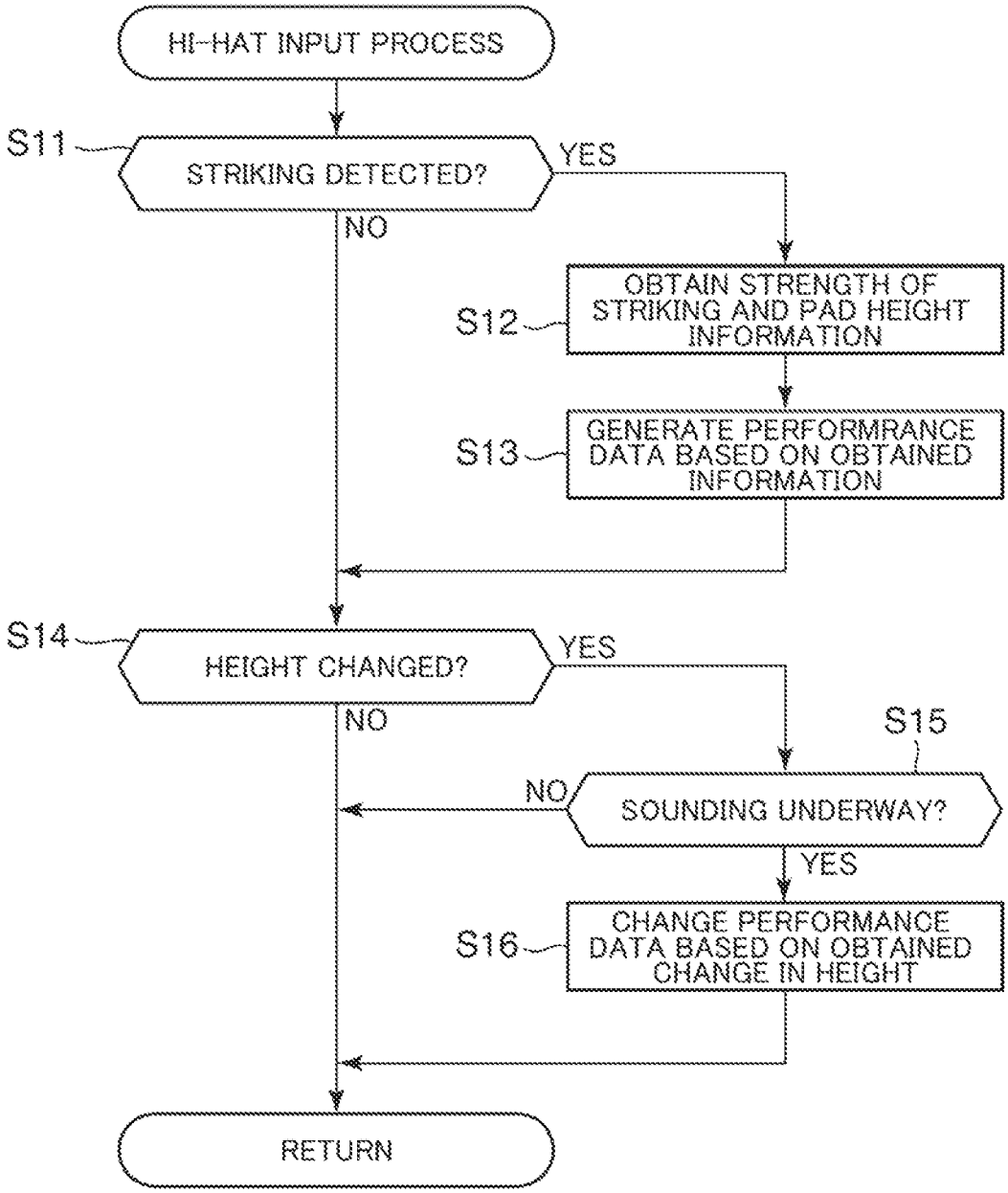
FIG. 6 is a flowchart showing the procedure of a hi-hat input process which is one process in the input receiving process appearing in FIG. 5.

FIG. 6 is a flowchart showing the procedure of a hi-hat input process which is a partial process in the input receiving process. This hi-hat input process is started when there is an input concerned with a hi-hat, that is, the electronic pad PD. Here, the words "when there is an input" mean when information is stored into the input event area or the pad height information storage area mentioned above.

When this hi-hat input process is started, that is, when there is any input concerned with the electronic pad PD, the CPU 101 judges whether or not the input is "detection of a strike" (step S11), "change in height" (step S14), or "others". It should be noted that in order to simplify this hi-hat input process, when the input is "others", the high-hat input process "returns" without a process being carried out even if this process should actually be carried out. The input of "others" includes an input that is made when the mute operation is performed.

As a result of the judgment, when striking is detected, the CPU 101 obtains a strength of the striking and pad height information from respective areas on the RAM 103 (step S12) and generates performance data based on obtained information (step S13).

On the other hand, when there is a change in height, the CPU 101 judges whether or not sounding is underway (step S15), and when sounding is underway, the CPU 101 changes the performance data based on the obtained information on the change in height (step S16). When the CPU 101 judges that sounding is not underway, the process returns because there is no performance data that should be changed.

It should be noted that this hi-hat input process is specialized for the electronic pad PD, and therefore, when an acoustic HH cymbal is used in place of the electronic pad PD, this hi-hat input process cannot be used as it is but needs to be changed. Specifically, since no strike detection signal is output from an acoustic HH cymbal, and hence a striking sound from the acoustic HH cymbal is detected using, for example, a microphone in "detection of a strike", and after this striking sound is appropriately processed, the CPU 101 should judge whether or not striking has been detected based on the processed striking sound. Similarly, as for "the strength of striking" as well, the CPU 101 should make a judgment based on a striking sound detected using the microphone.

As described above, in the present embodiment, since up/down motions of the HH pad body PDT caused by operation of the foot pedal are detected by detecting real motions of the HH pad body PDT itself, musical tones are controlled with a direct feel because an object to be detected and an object to be operated match up with each other.

Moreover, since the movement restricting unit 12 is adapted to be able to adjust the lowermost position of the HH pad body PDT restricted by the movement restricting unit 12, the positional relationship between the HH pad body PDT (a top cymbal in the case of an acoustic HH cymbal) and the volume 21 is appropriately set, and a setting is allowed to be offset on purpose (for example, response is advanced/delayed) according to preferences of a player (user), and hence musical tone control suited to preferences of the player is possible.

Figure 7:
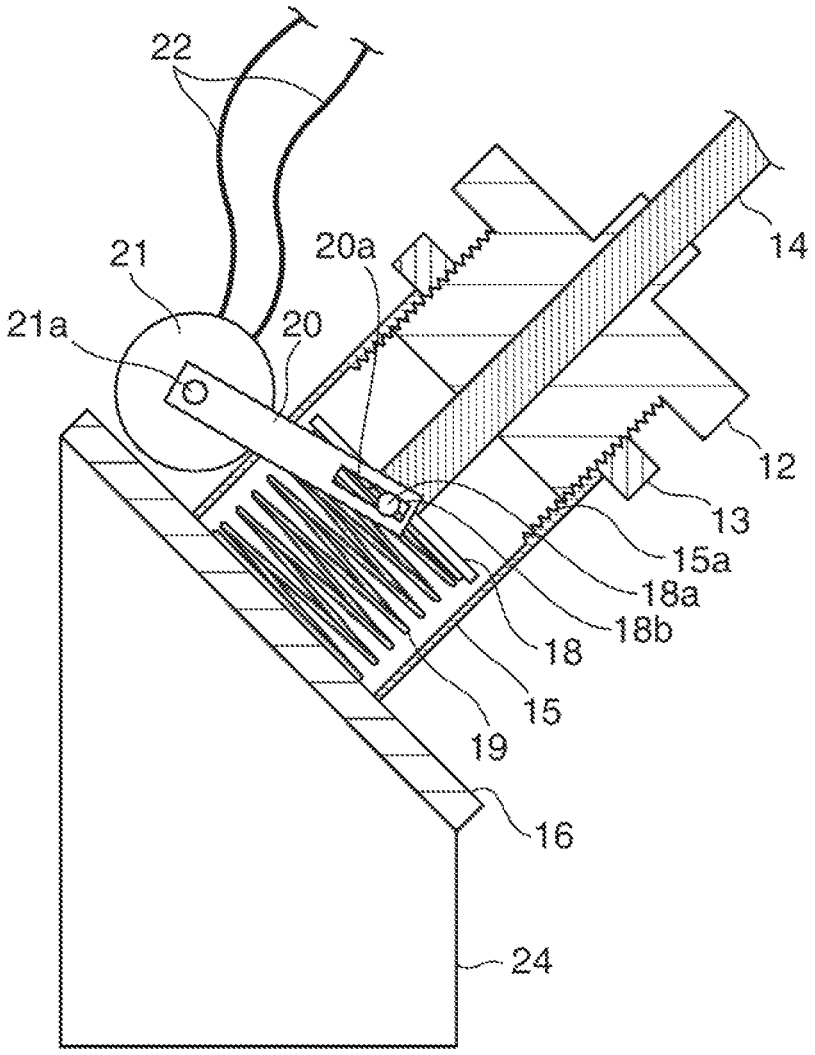
FIG. 7 is a partial cross-sectional view showing an internal construction of a variation of the up/down motion detecting apparatus for the hi-hat according to the embodiment of the present invention.

While the present invention has been described with reference to the embodiment above, it is to be understood that the invention is not limited to the embodiment described above. For example, the up/down motion detecting apparatus 10 is placed under and in proximity to the electronic pad PD, but the location where the up/down motion detecting apparatus 10 is placed is not limited to this. Here, the HH pad body PDT is moved up and down by the extension rod 202, and the extension rod 202 is moved up and down by the foot pedal. Thus, the up/down motion detecting apparatus 10 may detect up/down motions of the HH pad body PDT by detecting depression of the foot pedal. In this case, the up/down motion detecting apparatus 10 is placed in proximity to the foot pedal, that is, in proximity to the foot of a player, and as shown in FIG. 7, the seat unit 16 and the interlocked portion 14 are placed in a manner tilting approximately 45 degrees on an installation unit 24, which is a seat. The interlocked portion 14 linearly moves in response to depression of the foot pedal and in the direction in which the interlocked portion 14 extends. Depression of the foot pedal is a rotary motion about a base edge of the foot pedal, and hence the interlocked portion 14 is connected to the foot pedal via a link mechanism (not shown) that converts a rotary motion into a linear motion. It should be noted that in this case, the extension rod 202 and the bottom seat 60 are dispensed with.

It should be noted that the scope of the following claims is to be accorded the broadest interpretation so as to encompass all such modifications and equivalent structures and functions.

This application claims the benefit of Japanese Patent Application No. 2015-146481 filed on Jul. 24, 2015, which is hereby incorporated by reference herein in its entirety.

What is claimed is:

1. An up/down motion detecting apparatus for a hi-hat, comprising:

an interlocked portion configured to move in response to up/down motions of the hi-hat mounted on an extension rod that constitutes a hi-hat stand;

a seat unit configured to not move in response to up/down motions of the hi-hat;

a sensor provided on the seat unit; and a connecting portion connecting the interlocked portion and the sensor together and configured to convert up/down motions of the interlocked portion into motions detectable by the sensor; wherein the sensor is a rotary sensor having a knob that is rotatable, and the sensor detects an amount of rotation of the knob that corresponds to a height of up/down motions, wherein the connecting portion is directly connected to the sensor.

2. The up/down motion detecting apparatus for the hi-hat according to claim 1, wherein:

the sensor detects rotary motions, the interlocked portion has a projection, the connecting portion has a slotted hole, the projection is engaged with the slotted hole, and the connecting portion converts up/down motions of the interlocked portion into rotary motions by the projection sliding in contact with the slotted hole when the interlocked portion moves up and down.

3. The up/down motion detecting apparatus for the hi-hat according to claim 1, further comprising:

a holding and restricting unit configured to hold the interlocked portion so that the interlocked portion is slideable along the extension rod, and restricts a position to which the hi-hat moves down, wherein the holding and restricting unit is placed contiguous with the seat unit.

4. The up/down motion detecting apparatus for the hi-hat according to claim 1, further comprising a mounting portion configured to enable the seat unit to be placed on and mounted on a main body pipe that constitutes the hi-hat stand.

5. The up/down motion detecting apparatus for the hi-hat according to claim 2, wherein the sensor is connected to an interface, and inputs a voltage value, which is obtained by converting the rotary motion, and the interface converts the voltage value into height information on the hi-hat.

6. An electronic percussion instrument comprising:

an up/down motion detecting apparatus for a hi-hat;

a hi-hat performance data generator that generates a hi-hat performance data based on height information on the hi-hat, wherein the up/down motion detecting apparatus comprising:

an interlocked portion configured to move in response to up/down motions of the hi-hat mounted on an extension rod that constitutes a hi-hat stand;

a seat unit configured to not move in response to up/down motions of the hi-hat;

a sensor provided on the seat unit; and a connecting portion connecting the interlocked portion and the sensor together and configured to convert up/down motions of the interlocked portion into motions detectable by the sensor, wherein the connecting portion is directly connected to the sensor, wherein the sensor is connected to an interface, and inputs a voltage value that varies according to up/down motions of the hi-hat, wherein the interface converts the voltage value into the height information on the hi-hat, and wherein the performance data is changed based on the height information on the hi-hat; wherein the sensor is a rotary sensor having a knob that is rotatable, and the sensor detects an amount of rotation of the knob that corresponds to a height of up/down motions.

7. The up/down motion detecting apparatus for a hi-hat according to claim 3, wherein the holding and restricting unit is configured to be adjustable up and down relative to the hi-hat to restrict a lower position of the hi-hat.

8. The up/down motion detecting apparatus for a hi-hat according to claim 3, further comprising:

a mounting portion configured to enable the seat unit to be placed on and mounted on a main body pipe that constitutes the hi-hat stand, wherein the interlocked portion, the holding and restricting unit, the seat unit, and the mounting portion are configured to allow the extension rod to pass therethrough.

9. The up/down motion detecting apparatus for a hi-hat according to claim 1, wherein the sensor outputs an analog value.

10. The up/down motion detecting apparatus for a hi-hat according to claim 1, wherein:

the sensor is a rotary sensor having a knob that is rotatable, and the connecting portion comprises a linkage having one end thereof directly connected to the knob so that the knob rotates together with the linkage when the interlocked portion moves up/down.

11. The up/down motion detecting apparatus for a hi-hat according to claim 10, wherein:

the interlocked portion includes a projection, the linkage includes a slot that engages with the projection, and the projection moves along the slot when the interlocked portion moves up and down to permit the linkage to rotate about the knob to convert up/down motions of the interlocked portion into rotary motions.

12. The up/down motion detecting apparatus for a hi-hat according to claim 10, wherein the rotary sensor is fixed to the seat unit so that the rotary sensor does not move vertically with up/down motions of the interlocked portion.

13. The up/down motion detecting apparatus for a hi-hat according to claim 11, further comprising:

a holding and restricting unit configured to be adjustable up and down; and a cylindrical body adjustably supporting the holding and restricting unit to enable the holding and restricting unit to be adjustable up and down in relation to the cylindrical body, wherein the cylindrical body has a vertically extending slot to permit the projection to protrude therethough to permit the interlocked portion to move up/down.

14. The up/down motion detecting apparatus for a hi-hat according to claim 1, wherein the connecting portion is fixedly connected to the sensor.

15. The up/down motion detecting apparatus for a hi-hat according to claim 10, wherein the linkage is fixedly connected to the knob.

* * * * *